US005431046A

United States Patent [19]

Ho

[11] Patent Number: 5,431,046

[45] Date of Patent: Jul. 11, 1995

[54] COMPLIANCE-BASED TORQUE AND DRAG MONITORING SYSTEM AND METHOD

[76] Inventor: Hwa-Shan Ho, 5411 Mineral Creek Ct., Spring, Tex. 77379

[21] Appl. No.: 195,211

[22] Filed: Feb. 14, 1994

[51] Int. Cl.[6] ..... E21B 47/08

[52] U.S. Cl. ..... 73/151; 175/40

[58] Field of Search ..... 73/151, 151.5; 175/40, 175/45

[56] References Cited

U.S. PATENT DOCUMENTS

| | | | |
|---|---|---|---|
| 2,775,889 | 1/1957 | Decker | 73/151 |
| 3,785,202 | 1/1974 | Kelseaux et al. | 73/151.5 |
| 4,549,431 | 10/1985 | Soeiinah | 73/151 |
| 4,760,735 | 8/1988 | Sheppard et al. | 73/151 |
| 4,848,144 | 7/1989 | Ho | 73/151 |
| 4,852,665 | 8/1989 | Peltier et al. | 73/151 |
| 4,966,234 | 10/1990 | Whitten | 73/151 |
| 4,972,703 | 11/1990 | Ho | 73/151 |
| 5,044,198 | 9/1991 | Ho | 73/151 |
| 5,181,172 | 1/1993 | Whitten | 73/151 |

OTHER PUBLICATIONS

Johancsik, "Torque and Drag in Directional Wells" 1ADC/SPE, 1983.

Brett, "Users and Limitations of a Drillstring Tension and Torque Model" SPE, 1987.

Lesage, "Evaluating Drilling Practice in Deviated Wells", SPE/1ADC, 1987.

Ho, "General Formulation of Drillstring" SPE, 1986.

*Primary Examiner*—Hezron E. Williams
*Assistant Examiner*—Michael J. Brock
*Attorney, Agent, or Firm*—Harrison & Egbert

[57] ABSTRACT

A drilling torque and drag monitoring method for a drillstring in a well bore including the steps of measuring hook load and axial displacement of the drillstring, measuring surface torque and angular position of the drillstring, correlating the hook load with the axial displacement of the drillstring so as to produce a first graphical relationship, correlating the surface torque and the angular position measurements of the drillstring so as to produce a second graphical relationship, and comparing the first and second graphical relationships so as to determine a contact resistance between the drillstring and the well bore. These relationships can be used independently or jointly so as to determine the condition of contact resistance. The method includes the step of identifying a slope discontinuity along the graphical curve. This slope discontinuity is indicative of a contact resistance. When the slope discontinuity is a curved segment, then the curvature of the curved segment is computed so as to be representative of a magnitude of a distributed contact resistance along the area of contact between the drillstring and the well bore. An instantaneous axial or rotational compliance can be determined at a point along the slope of the graphical representations. The depth of the area of contact can be computed based upon the instantaneous axial or rotational compliance relative to a given surface axial location or a given surface torque applied to the drillstring.

9 Claims, 6 Drawing Sheets

COMPLIANCE-BASED TORQUE AND DRAG MONITORING SYSTEM AND METHOD

TECHNICAL FIELD

The present invention relates to methods for carrying out downhole measurements from the surface of an oil well. More particularly, the present invention relates to methods for determining torque and drag. Additionally, the present invention relates to methods for determining areas of contact between a drillstring and a well bore.

BACKGROUND ART

The oil and gas drilling industry has been undergoing dramatic technology improvements in the last decade, particularly in MWD (Measurement-While-Drilling), directional and horizontal drilling, improved drilling tools and equipment and improved analysis and monitoring capabilities. The combined effect is that drilling cost has been steadily declining, and directional drilling, particularly high-angle, extended reach, and horizontal drilling have become much more popular, and will further see expanded application in the future.

At the same time, due to cost cutting efforts and down-sizing, more and more wells are being drilled on a "turn-key" basis, whereby service companies are asked to contract the entire drilling project at a predetermined benchmark fee, with huge incentives for faster and better drilling, and similar penalties for incurring drilling problems and drilling delays.

The advent of these turn-key projects forecasts an economic condition under which those service companies that are able to improve the drilling operation will reap major profits. Those companies that do not improve may suffer major losses. One single severe incident of a stuck-pipe can mean a loss of hundreds of thousands of dollars in revenue loss, if not more.

A key in preventing pipe-sticking is to improve the monitoring of the well bore resistance, called the torque and drag. Torque and drag result from contact between the drillstring and the well bore of the directional well.

The current method of torque and drag monitoring is to measure the surface loads only, namely, the hook load and surface torque. Many rigs still rely on crude surface measurements. Some have more advanced axial load and torque measurements.

Additionally, numerical simulations using so-called "torque-drag model" programs are also being employed for checks and as planning tools. These torque-drag simulation models are referred to as "soft-string" models. That is to say, the drillstring is treated as without any bending stiffness. The present inventor introduced the "stiff-string model". This model compares the results of the drag generated by actual BHA (bottomhole assembly) deformation using a BHA analysis program. Significant differences were found between the results of the "soft-string" model and the "stiff-string" model. These differences become more pronounced as the stiffness of the BHA increases, as the clearance decreases, and as the well path becomes more crooked. All these models require very specific and detailed information about the well path and the friction "coefficients", which are very hard to actually determine precisely.

Various U.S. patents have issued to the present inventor in the field of the present invention. U.S. Pat. No. 4,848,144 (issued on Jul. 18, 1989), U.S. Pat. No. 4,972,702 (issued on Nov. 27, 1990), and U.S. Pat. No. 5,044,198 (issued on Sep. 3, 1991) have addressed methods of predicting the torque and drag in directional wells. These patents describe a method for generating an improved torque-drag model for at least the collar portion of the drillstring in a directional oil or gas well. The technique of these patents determines the stiffness of incremental portions of the drillstring, and uses this information, along with the borehole clearance and the borehole trajectory, to determine the contact locations between the drillstring and the sidewalls of the well. The contact force at these determined locations can be calculated, taking into consideration all significant kinematic, external, and internal forces acting on that incremental portion of the drillstring. More accurate torque-drag analysis, provided by the model of these patents, assists in well planning, prediction and control, and assists in avoiding drilling problems. This method serves to reduce total costs for the well.

It is an object of the present invention to provide a method for the monitoring and computing of torque and drag in the well bore.

It is another object of the present invention to provide a method that more precisely determines well bore resistance.

It is another object of the present invention to provide a method of determining well bore resistance with less detailed information about the well bore and the friction coefficients.

It is another object of the present invention to provide a method that allows for the determination of contact locations and the magnitudes of the restraining forces and/or torques.

It is a further object of the present invention to provide a method that allows for the locating of the critical sticking point between the drillstring and the well bore.

It is still a further object of the present invention to provide a method that improves the modelling of the well bore system.

These and other objects and advantages of the present invention will become apparent from a reading of the attached specification and appended claims.

SUMMARY OF THE INVENTION

The present invention is a drilling torque and drag monitoring method for a drillstring in a well bore that comprises the steps of:

(1) measuring hook load and axial displacement of the drillstring;

(2) measuring surface torque and angular position of the drillstring;

(3) correlating the measurements of hook load and axial displacement of the drillstring so as to produce a first graphical relationship;

(4) correlating the surface torque and the angular position measurements of the drillstring so as to produce a second graphical relationship; and (5) comparing the first and second graphical relationships so as to determine an area of contact between the drillstring and the well bore.

The hook load and axial displacement are measured at a similar axial location along the drillstring. The surface torque and angular position are also measured at a similar axial location along the drillstring. The measurements are preferably made at a location above the well bore.

In the present invention, the steps of comparing the graphical representations includes the steps of:

(1) computing a slope of the relationship of hook load and axial displacement;

(2) determining an instantaneous axial compliance at a point along the slope; and (3) computing a depth of the area of contact based upon the instantaneous axial compliance relative to a given surface axial load. In the method of the present invention a slope discontinuity is identified along the curve. This slope discontinuity is indicative of an area of contact between the drillstring and the well bore. If this slope discontinuity is a curved segment, then the step of identifying includes the step of computing a curvature of the curve segment. This curvature is representative of a magnitude of the distributed contact force along the area of contact between the drillstring and the well bore.

The method of comparing also includes the steps of:

(1) computing a slope of the relationship of surface torque and angular position;

(2) determining an instantaneous rotational compliance at a point along the curve; and (3) computing a depth of the area of contact based on the instantaneous rotational compliance relative to a given surface torque. This method also includes the step of forming a graphical curve of the relationship of surface torque and angular position and identifying the slope discontinuity along the graphical curve. The slope discontinuity is indicative of the area of contact. If the slope discontinuity is a curved segment, then the curvature of the curve should be computed so as to be representative of a magnitude of a distributed area of contact between the drillstring and the well bore.

In the method of the present invention, either the measurement of hook load and axial displacement or the measurement of surface torque and angular position can be utilized for the purposes of identifying the position of an area of contact between the drillstring and the well bore. These measurements can be correlated together so as to check for variations in friction coefficient, to better model the formation and/or to provide for better accuracy and confirmation.

It is important to note various terms that are used herein in relation to the claims and specification of the present invention. The term "drill string" includes coiled tubing. The phrases "graphical relationship" and "graphical slope" refers to the formation of an actual physical graph and also includes the generation of graphical-type information correlative of a two-axis representation of force versus movement. This representation can be physical or part of computer processing. The term "graphical curve" is inclusive of curves and/or straight line representations of relationships of physical quantities. The term "hook load" refers to and includes the surface axial load of the drillstring.

DETAILED DESCRIPTION OF THE INVENTION

Figure 1:
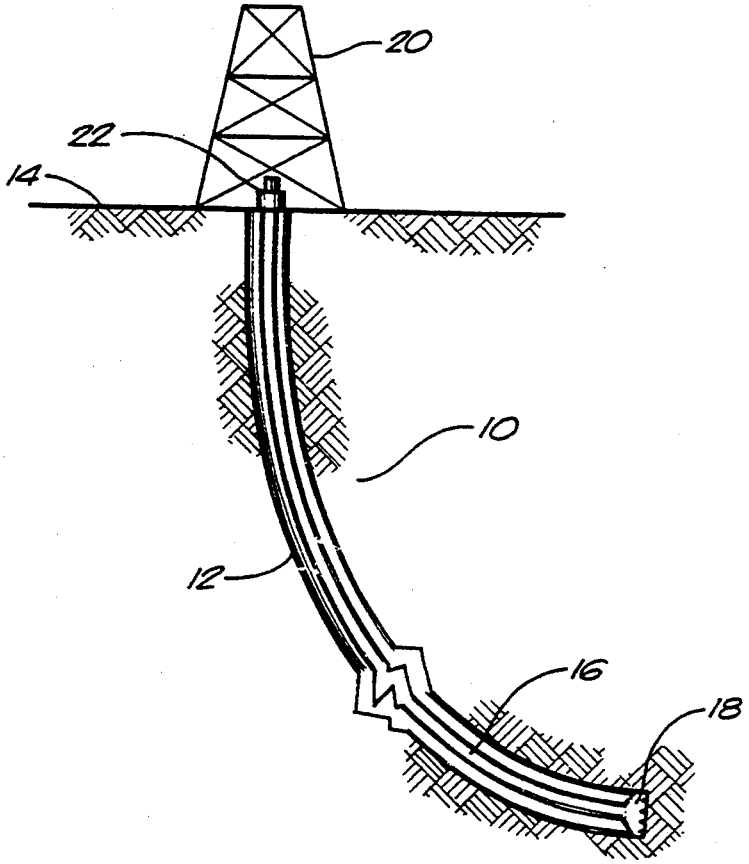
FIG. 1 is a cross-sectional illustration of a directional drilling operation.

Referring to FIG. 1, there is shown at 10 a directional well of a type in which the present invention finds application. As can be seen, the directional well 10 includes a well bore 12 extending from the surface 14 into the earth at a desired amount of curvature. The drillstring 16 extends within the well bore 12. A drill bit 18 is positioned at the end of the drillstring 16 so as to drill into the earth. The drilling rig 20 is positioned on surface 14 for the control of the drillstring 16 and the other drilling activities.

Importantly, at the surface 14, it is possible to carry out measurements at 22 of both the axial force as well as the axial displacement of the drillstring 16. Additionally, at location 22, it is possible to measure the torque (torsional moment) as well as angular position of the drillstring 16. This is an important aspect of the present invention in which the compliance of the drillstring 16 can be determined with surface measurements. The present invention allows two separate formulations to be determined. One of these determinations is for axial compliance and the other determination is for rotational compliance. Alternatively, it is possible to use the impedances of these formulations, which are inverse to the respective compliances of the system. The measurement of axial displacement versus the axial force allows the relationship between these quantities to be plotted graphically. Similarly, the relationship of angular position versus torque can be plotted graphically. The instantaneous slopes of these curves are the axial compliance and the rotational compliance of the drilling system 10. These compliance diagrams will be described hereinafter.

The present invention provides an entirely different approach to the measurement and monitoring of the resistance of the drillstring 16 within the well bore 12. In addition to measuring the surface torque and hook load, the present invention also measures the angular position and the axial travel. These measurements are carried out at the same surface location (such as the swivel of the drilling rig 20). These measurements can be utilized so as to arrive at the "compliance" of the drillstring. This "compliance" indicates the rate of axial travel under a unit increase in axial load. As a result, the current invention is a "compliance-based" monitoring system, since the rate of axial travel increase under unit axial load increase is the axial compliance of the system.

By measuring the axial travel, such as depth of the swivel, along with the hook load at the swivel, it is possible to establish the axial compliance of the drillstring 16 within the well bore 12. Similarly, by measuring the surface drillstring rotation, along with the surface torque, it is possible to establish the rotational compliance of the drillstring 16. These two compliances yield a great deal of information regarding the location, distribution and magnitude of the contact forces between the drillstring 16 and the borehole wall 12. This information is not available in current torque-drag measurement systems, even with the aid of additional numerical simulations.

Figure 2:
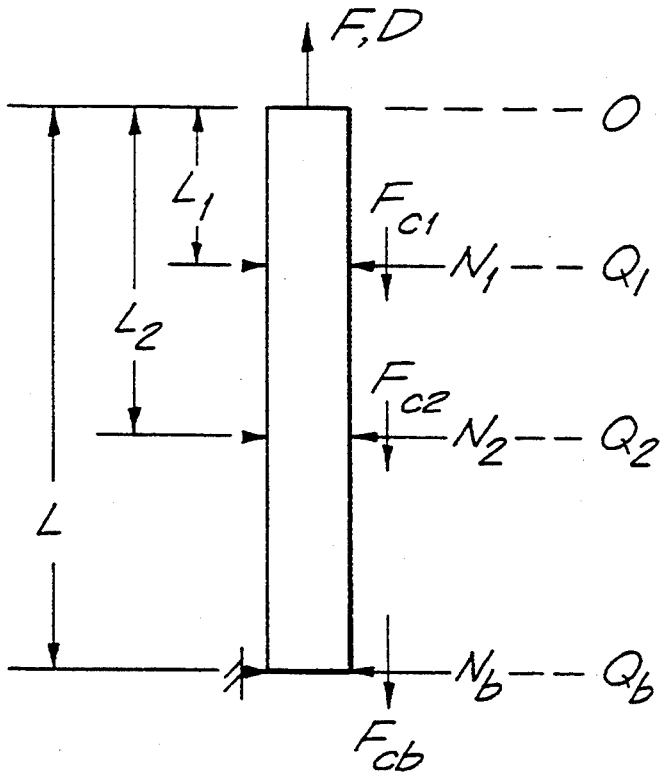
FIG. 2 is a force diagram showing the forces acting on a vertical drillstring with only discrete contact points with the well bore.

FIG. 2 shows a vertical drillstring of length L, whose (assumed clamped) bottom is at point $Q_b$ and is in contact at two intermediate points: point $Q_b$, at $L_1$ and point $Q_2$ at $L_2$, all locations being measured from the top (point O). The axial restraining forces due to contacts at the three points are, respectively: $F_{c1}$, $F_{c2}$, and $F_{cb}$. They are obtainable from multiplying the normal contact forces $N_1$, $N_2$, and $N_b$ by the drag friction coefficients $\mu_1$, $\mu_2$, and $\mu_b$, respectively. That is: $F_{cb}=\mu_b N_b$, etc. In uniform formations, these drag friction coefficients should be the same.

Figure 3:
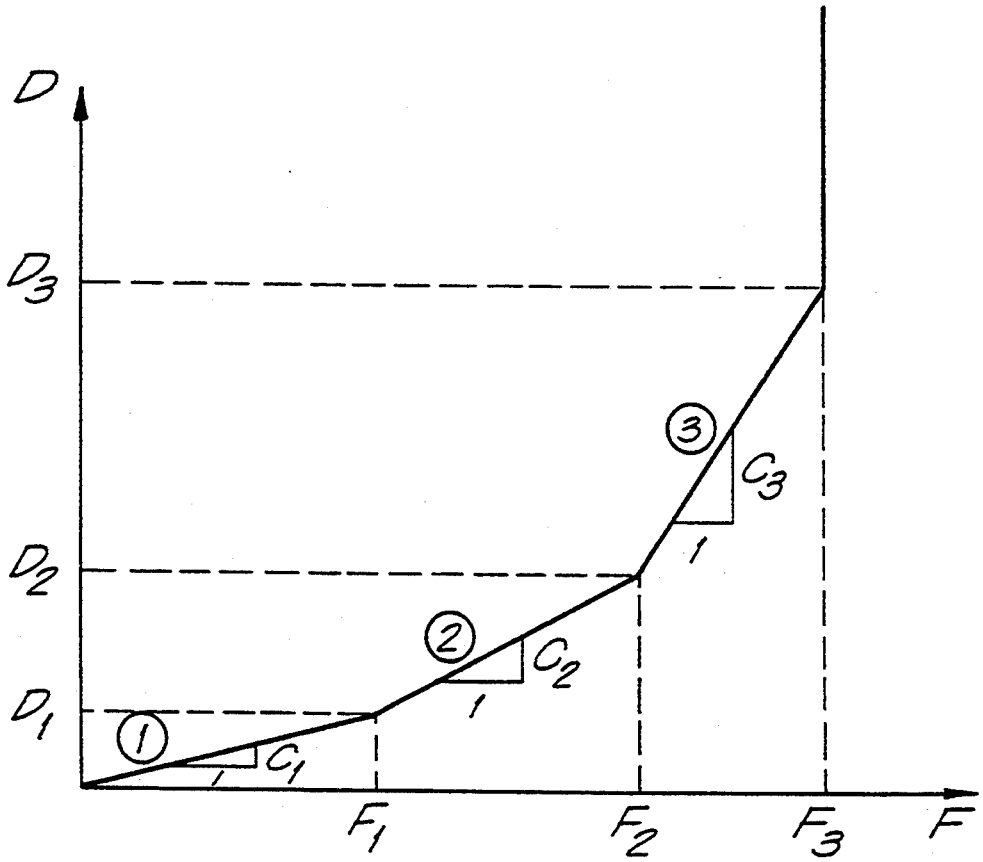
FIG. 3 is a graphical relationship of a compliance diagram showing the relationship of force versus displacement.

The axial compliance diagram, which relates the axial displacement, D, versus the axial force, F, appears as FIG. 3. Three load regions are shown: low, intermediate, and high load regions, denoted by regions 1, 2, and 3, respectively in the diagram.

In region 1, the origin of the diagram represents the initial state (with buoyed dead weight present) of the drillstring before any axial load (over the initial load supporting the buoyed dead weight) is applied. The upper limit ($D_1$, $F_1$) represents the instant when the axial load is large enough to overcome the friction force imposed by the contact force at the intermediate point $Q_1$. Within this load region, the system behaves as if only the top section O $Q_1$, exists. The D(F) diagram is the following straight line:

$$D = \frac{FL_1}{AE} \tag{1}$$

where E is the Young's modulus and A is the cross sectional area of the drillstring. The axial compliance of the system, $C_1$, is the slope of this line:

$$C_1 = D/F = \frac{L_1}{AE} \tag{2}$$

At the upper load limit $F_1$, the elongation equals to $$D_1 = \frac{F_{c1} L_1}{AE} \tag{3}$$

In the lowest load region 1, $O \leqq F \leqq F_1 = F_{c1}$; $O \leqq D \leqq D_1$.

When the axial force exceeds $F_1$, the remaining force is exerted on the lower section to location $Q_2$. This applies until the restraining force at that location, $F_{c2}$, is also overcome. The D(F) diagram, shown as region 2 in FIG. 3, is again a straight line:

$$D = \frac{FL_1}{AE} + \frac{(F - F_{c1})(L_2 - L_1)}{AE} \tag{4}$$

This equation can be rewritten to:

$$D - D_1 = \frac{(F - F_{c1}) L_2}{AE} \tag{5}$$

The axial compliance is again the slope of the D(F) curve, and reflects the compliance of the string between the top and $Q_2$:

$$C_2 = dD/dF = \frac{L_2}{AE} \tag{6}$$

At the upper load limit $F_2=F_{c1}+F_{c2}$, the total elongation is $D_2$:

$$D_2 = \frac{F_{c1} L_1}{AE} + \frac{F_{c2} L_2}{AE} \tag{7}$$

In the intermediate load region 2, $F_{c1}=F_1 \leqq F \leqq F_2 = F_1 + F_2$; $D_1 \leqq D \leqq D_2$.

In the highest load region, similar to region 2, when the axial force exceeds $F_2$, the remaining force is exerted on the remaining lower section to the bottom location $Q_b$. The D(F) diagram, shown as region 3 in FIG. 3, is again a straight line:

$$D = \frac{FL_1}{AE} + \frac{(F - F_{c1})(L_2 - L_1)}{AE} + \frac{(F - F_{c1} - F_{c2})(L - L_2)}{AE} \tag{8}$$

Similar to load region 2, the above equation can be rewritten into:

$$D - D_2 = \frac{(F - F_{c1} - F_{c2}) L}{AE} \tag{9}$$

The axial compliance of the system now reflects that of the whole string:

$$C_3 = dD/dF = \frac{L}{AE} \tag{10}$$

Finally, when the axial load overcomes the clamping force at the bottom $F_{cb}$, then $F_b=F_{c1}+F_{c2}+F_{cb}$. The total elongation is $D_3$.

$$D_3 = \frac{F_{c1} L_1}{AE} + \frac{F_{c2} L_2}{AE} + \frac{F_{cb} L}{AE} \tag{11}$$

The axial load cannot exceed the $F_b$. Axial elongation becomes unlimited beyond this load level, that is, the drillstring will trip out. In this case, the axial compliance becomes infinite. In the highest load region, $F_{c1}+F_{c2}=F_2 \leqq F \leqq F_3 = F_{c1}+F_{c2}+F_{cb}$; and $D_2 \leqq D \leqq D_3$.

One important consideration is that, during the application of the axial location F, the restraining forces $F_{c1}$, $F_{c2}$, and $F_{cb}$ remain unchanged. This holds true for straight wells.

Figure 4:
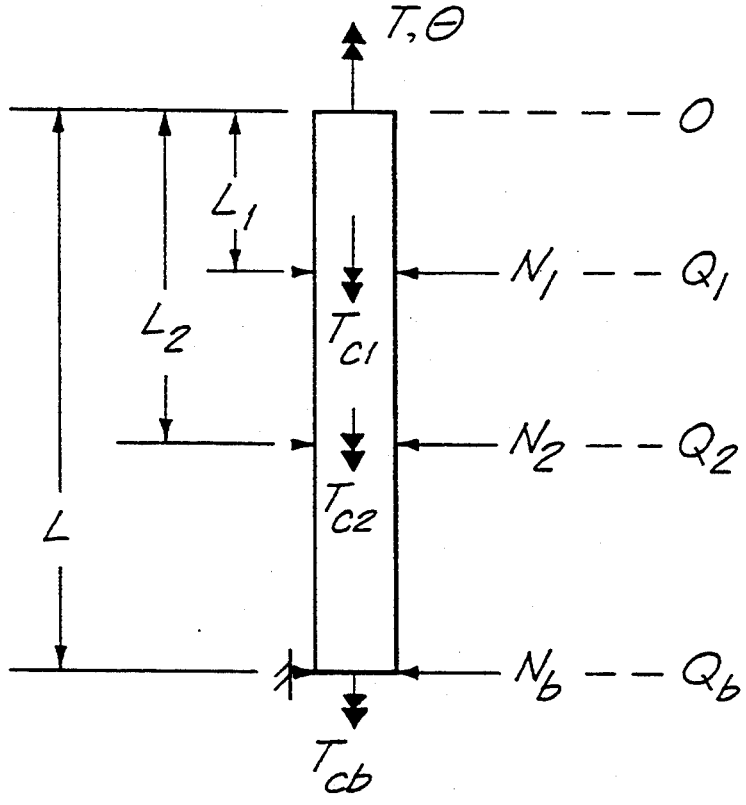
FIG. 4 is a force diagram showing the relationship of torque and rotation as acting on a drillstring.

The present invention also allows for the determination of rotational compliance. FIG. 4 shows the contact resistant torques applicable to a drillstring in contact with a well bore. FIG. 4 assumes that there are contact resistant torques $T_{c1}$, $T_{c2}$, and $T_{cb}$ applied at the discrete points $Q_1$, $Q_2$ and $Q_b$. These resistant torques are obtainable from multiplying the normal contact forces $N_1$, $N_2$, and $N_b$ by the rotational friction coefficients and the radius of the drillstring at the respective locations. That is: $T_{cb}=\mu_b N_b r_b$, etc.

The formulation of the rotational compliance is identical to that for the axial compliance by substituting T for F, $T_c$ for $F_c$, $\theta$ for D, GJ for AE, and $C_r$ for C. Here J is the polar moment of inertia of the drillstring section, and G is the shear modulus. The rotational compliance diagram is parallel to that of FIG. 3 by replacing F by T, and D by $\theta$.

The above formulations can yield much useful information regarding the condition of contact between the drillstring and the borehole wall. Each load point on the respective (axial or rotational) compliance diagram (FIGS. 3 or 4) represents a physical point on the drillstring (FIG. 2), moving from the top of the drillstring downward as the load increases. Whenever the compliance diagram is a straight line between two points in the diagram, there are no intermittent contacts between the drillstring and the borehole wall within the two corresponding physical points on the drillstring. The slope of the compliance diagram represents the compliance of the system within the prescribed load ranges. It determines the "effective support length" of the drillstring, below which no load is transmitted onto the drillstring other than the buoyed dead weight. Each "critical load point" on the compliance diagram, such as the starting point and the line intersection points, represents a physical point on the drillstring where a concentrated contact restraining load is applied onto the drillstring. The magnitude of this load is proportional to the discontinuity in the slopes of the diagram across the critical load point. The location of the critical load point is determined by using the compliance (slope) between the lower load point and the next load point whose physical point is to be located. If the drillstring is not stuck, there exists an absolute upper limit to the load level. Otherwise, the diagram will continue its last leg of straight line.

These interpretations of the compliance diagrams afford powerful inferences on the detailed conditions of contact between the drillstring and the borehole wall. To establish the two compliance diagrams (or functional relations), one way is to pick up the drillstring after drilling (while still touching bottom). Another way is to stop drilling and further reduce the hook load, all the while recording both the surface loads and the surface displacements.

In real life, the drillstring is composed of non-uniform sections, having drill collars, heavy weight drill pipes, and regular drill pipes, as well as other downhole tools. The formulation will become more complex due to the need to account for changing "axial rigidity" AE, and "torsional rigidity" JG. However, these are presumed to be known in advance, and should not pose any substantive difference to the entire methodology.

When the contact points are infinitesimally spaced apart, i.e., when the contact load is distributed rather than concentrated, the ensuing displacement-load curve in the compliance diagram will no longer be of straight lines. Instead, there will be a curve with continuously and monotonically increasing slope under increasing load.

Figure 6:
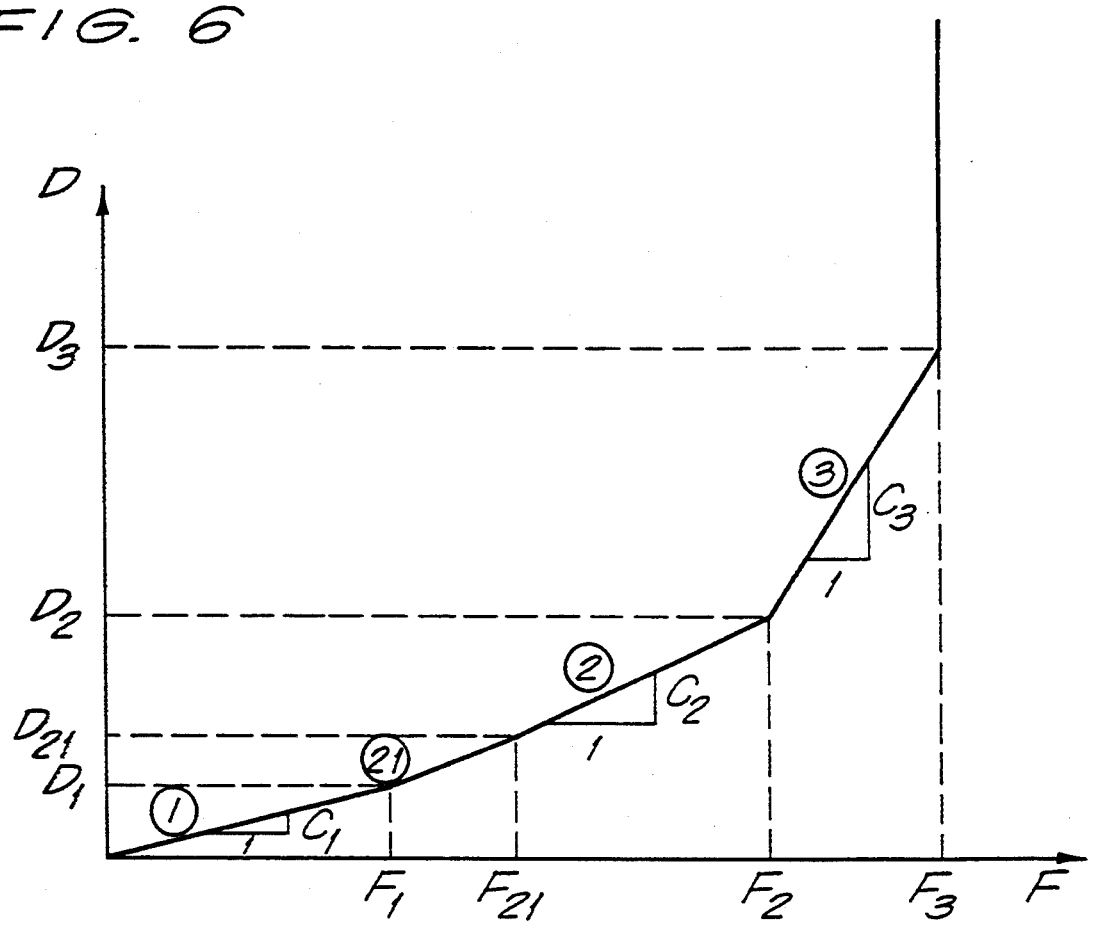
FIG. 6 is a compliance diagram showing the relationship of forces versus displacement for the force diagram of FIG. 5.

As illustration, assume that the portion between $Q_1$ and $Q_2$ in FIG. 1 is under uniform continuous contact resistance, with a frictional drag of constant magnitude, f, having the dimension of force per unit length. It is be assumed that there also exists concentrated contact resistance at the two points as before. Therefore, in the compliance diagram, shown in FIG. 6, point $F_{c1}$ remains the same as before. It is now necessary to examine what happens between $F_{c1}$ and $F_{c2}$.

Figure 5:
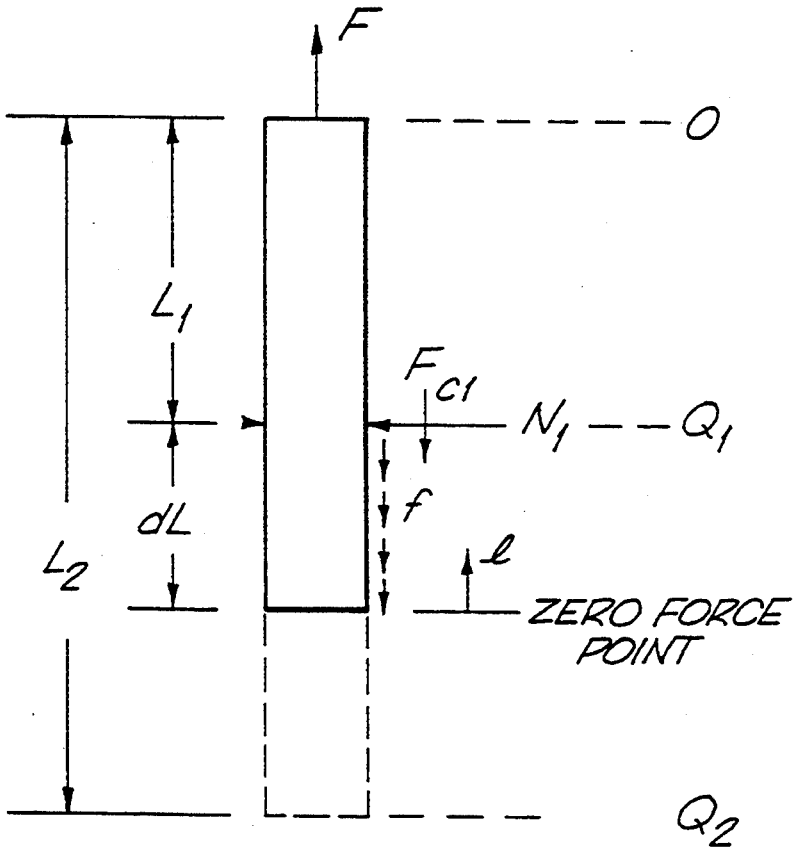
FIG. 5 is a force diagram showing the relationship of forces in which a drillstring is in distributed contact with a well bore.

In FIG. 5 there is shown a free body of a segment of the drillstring, between physical points $Q_1$ and $Q_2$ at a distance of dL from $Q_1$, where the load effect is totally compensated by the drag resistance. This distance is determined by the applied load level as follows:

$$dL=(F-F_{c1})/f \tag{12}$$

In other words, no axial load is transmitted below this point. To compute the total elongation observed at the surface, the following two parts should be added:

(1) In the section $OF_1$, where the load is uniform, therefore:

$$D_1=FL_1 / (AE) \tag{13}$$

(2) In the section dL, where the axial force starts at zero and increases to $F_{c1}$ at point $Q_1$. The elongation can be obtained by integrating the axial strain $\epsilon(1)$, where 1 is measured upward from the lower end:

$$\epsilon(l)=fl/(AE),\ 0\leqq l\leqq dL \tag{14}$$

This results in:

$$D_2=f\,dL^2 / (2AE) \tag{15}$$

Therefore, by adding these two components, the following result occurs:

$$\begin{aligned} D &= FL_1/(AE) + f\,dL^2/(2AE) \\ &= FL_1/(AE) + (F-F_{c1})^2/(2fAE) \end{aligned} \tag{16}$$

The axial compliance is now linearly increasing as the load increases:

$$C_{21}=dD/dF=L_1/(AE)+(F-F_{c1}) / (fAE) \tag{17}$$

As dL just reaches the lower point $Q_2$, the load is $F_{21}$:

$$F_{21}=F_{c1}+f(L_2-L_1) \tag{18}$$

At this time, the compliance is $$C_{21}=L_2 / (AE) \tag{19}$$

An additional load increase is needed in order to overcome the concentrated drag resistance at $Q_2$. This follows the same slope as $C_{21}$ from ($D_{21}$, $F_{21}$) to ($D_2$, $F_2$) in the compliance diagram.

Whenever distributed contact exists, the compliance diagram is smoothly varying between the two points, with no slope discontinuities at the lower end of the curve. Additional concentrated restraining load at the lower end is exhibited by a straight line in the compliance diagram having the same slope as the upper end of the curve.

In directional wells, the drillstring is bent into a curve due to the well bore contact. For a curved well bore trajectory in a directional well the normal contact force distribution is n(L), where L is again the measured depth from the surface along the drillstring.

The application of the rotational compliance to directional wells is straight forward. This is due to the fact that the distributed torque is transmitted directly to the torsion in the curved drillstring. Along any curved drillstring section at arc location L, the rate of change of the drillstring torque, T(L), is only influenced by the distributed contact torque, t(L), by the following formula:

$$d\,T(L) / dL=t(L)=\mu r\,n(L) \tag{20}$$

The equation is not affected by the curvature or other force and moment components acting on the drillstring. Furthermore, the distributed normal contact force n(L)

is also not affected by the application of surface torque T. Therefore, the behavior and interpretation of the rotational compliance diagram in directional wells is identical to that in a straight well.

The interpretation of drag in directional wells requires some modification. As known previously:

$$dF(L)/dL = \mu n(L) - \gamma\cos\theta_d \quad (21)$$
$$n^2(L) = [F(L)k_b + \gamma d\theta_d/(k_b dL)\sin\theta_d]^2 + [\gamma d\theta_d/(k_b dL)\sin^2\theta_d]^2$$

These equations show that the distributed normal contact force n(L) is a function of the applied axial load. As axial load is increased (while pulling out of well), so will n(L). Therefore, infering n(L) from the axial compliance diagram will be different. However, the methodology will be the same.

One very important feature of this invention is that we can compare the n(L) profile from the rotational compliance diagram to that of the axial compliance diagram. The rotational n(L) profile measures when no additional axial pull is applied, while the n(L) profile in the axial compliance diagram measures under tripping conditions and is therefore higher or lower than that of the former. The different infered n(L) values may be used to define the "overpull factor" which is important when remedial measures are to be used to free the stuck pipe.

A key in preventing pipe-sticking in well drilling is to improve the monitoring of the well bore resistance which results from contact between the drillstring and the wall of the well bore. These contacts occur naturally in directional (including horizontal and long reach) wells due to gravity. They also occur due to crooked drilling conditions which cause key seating and stabilizer hanging. If the pipe-sticking is excessive, then very expensive drilling problems can result, such as lost pipe, plug back, side track, or even abandonment of the hole. A crooked well path is also very detrimental in running casing, completion, cementing, and may adversely impact the long term well bore stability and reservoir production performance. As a result, effective early warning of excessive torque and drag is very important.

The present invention provides a new system for monitoring and computing the torque and drag in the well bore in any well. This system employs the measurement of the axial and/or rotational compliances of the drillstring, and not just the surface loads (hook load and surface torque) alone, which are the present standard measurements. The present invention permits much higher precision in the determination of the well bore resistance, while requiring much less detailed information about the well bore and the friction coefficients. The present invention allows the determination of the contact locations and the magnitudes of the restraining forces and/or torques. It also permits the locating of the critical sticking point, including the "free point" when the drillstring is truly stuck. It therefore permits much more precise early warning of any impending pipe sticking problems, and enables more effective remedial procedures.

In the present invention, the hook load (or other surface axial load measurement) is measured, along with the axial displacement of the drillstring (or coiled tubing) at substantially the same axial location. Additionally, the surface torque and the angular position of the drillstring (or coiled tubing) is measured in substantially the same axial location. The axial measurements are correlated so as to establish the axial compliance diagram of the system. The axial measurements are, alternatively, correlated so as to establish the axial impedance diagram of the system. The rotational measurements are correlated so as to establish the rotational compliance diagram of the system or, alternatively, the rotational measurements are correlated so as to establish the rotational impedance diagram of the system. These diagrams can jointly and/or independently infer the contact locations and magnitudes of the contact restraining forces and torques.

The compliance diagrams are formulated by plotting or correlating the surface axial displacement as a function of the surface axial load. This yields the axial compliance diagram. The surface rotation, as a function of the surface torque, can be plotted or correlated so as to yield the rotational compliance diagram. Still alternatively, the surface axial load can be plotted or correlated as a function of the surface axial displacement so as to yield the axial impedance diagram. Also, the surface torque can be plotted as a function of the surface rotation so as to yield the rotational impedance diagram.

The slope of the axial compliance diagram can be computed so as to yield the instantaneous axial compliance of the system under any given surface axial location. This compliance is used so as to compute the "effective depth" of the contact load. Any discontinuities in the slope can be used so as to infer the presence and/or the magnitude of the concentrated axial contact restraint. The curvature of the compliance curve can be also used to determine the magnitude of the distributed axial contact restraint.

Inversely, the computing of the slope of the axial impedance diagram can yield the instantaneous axial rigidity of the system under any given surface axial load. This rigidity can be used to compute the "effective depth" of the contact load. Any slope discontinuities can be used to infer the presence and/or the magnitude of the concentrated axial contact restraint. The curvature of the impedance curve can be used so as to determine the magnitude of the distributed axial contact restraint.

For the measurement of the rotational contact constraint condition, the slope is computed for the rotational compliance diagram so as to yield the instantaneous rotational compliance of the system under any given surface torque. This compliance can be used to compute the "effective depth" of the contact load. Any discontinuities in the slope can be used to infer the presence and/or the magnitude of the concentrated contact restraining torque. The curvature of the compliance curve is used to determine the magnitude of the distributed contact restraining torque.

In the inverse, the rotational contact constraint condition can be calculated by computing the slope of the rotational "impedance" diagram so as to yield instantaneous rotational impedance of the system under any given surface torque. This impedance can be used to compute the "effective depth" of the contact load. The slope discontinuities are used to infer the presence and/or the magnitude of the concentrated contact restraining torque. The curvature of the impedance curve is used to determine the magnitude of the distributed contact restraining torque.

The present invention also provides a method for detecting the shallowest point of contact between the drillstring (or coiled tubing) and the borehole wall. This point may be the beginning of "helical buckling" with continuous wall contact when the drillstring is under compression, particularly when the coiled tubings are used for drillstring.

The present invention can also be a method of indicating the free point of a stuck drillstring which includes the steps of establishing the axial compliance diagram for the drillstring, finding the limit value of the slope of the compliance diagram, and then determining the stuck point of the drillstring using the limit slope and the known drillstring composition. This avoids the problem of having to utilize a wireline free point indicator.

The present invention also offers a method of detecting the local well path crookedness by utilizing the steps of measuring the axial and rotational compliances (or impedances of the system). The contact locations and magnitudes of the contact restraints are determined from the compliance diagrams. This allows the friction coefficient and the normal contact force to be inferred under the current condition. The expected normal contact forces are computed using a numerical torque-drag simulation program, with given well trajectories interpolated from the survey station data. The measurement-inferred normal contact forces are compared to the simulation-inferred normal contact forces. The survey profile along with the steps of comparing the forces, are iterated until the results coincide with the measurement-inferred normal contact forces.

The foregoing disclosure and description of the invention is illustrative and explanatory thereof. Various changes in the steps of the described method may be made within the scope of the appended claims without departing from the true spirit of the invention. The present invention should only be limited by the following claims and their legal equivalents.

NOMENCLATURES

F: Axial load, positive if tension.
T: Torque
r: Radius of drillstring
L: Measured depth from surface along drillstring
E: Young's modulus of drillstring
G: Shear modulus of drillstring
A: Cross sectional area of drillstring
J: Polar moment of inertial of drillstring cross section
D: Axial displacement at surface
C: Axial compliance
$\theta$: Rotation angle at surface
$C_r$: Rotational compliance
N: Normal contact force
$\mu$: Friction coefficient
$F_c$: Axial constraint due to normal contact force, $=\mu N$
$T_c$: Torque constraint due to normal contact force, $=\mu r N$
n(L): Distributed normal contact forces
f(L): Distributed axial constraint due to contact
t(L): Distributed torque constraint due to contact
$k_b(L)$: Principal curvature of the deformed drillstring
$\gamma(L)$: Buoyed weight per unit length of drillstring
$\theta_a(L)$: Azimuth angle of well profile
$\theta_d(L)$: Deviation angle of well profile

I claim:

1. A method of determining a condition of contact resistance between a drillstring and a well bore comprising the steps of:

measuring hook load and axial displacement of the drillstring while raising the drillstring from a resting position;

correlating the measurements of hook load and axial displacement so as to produce a graphical curve of the correlation; and identifying a slope discontinuity along said graphical curve, said slope discontinuity being indicative of contact resistance along an area of contact between the drillstring and the well bore, said slope discontinuity being a curved segment, said step of identifying comprising:

computing a curvature of said curved segment, said curvature representative of a magnitude of a distributed area of contact resistance between the drillstring and the well bore.

2. The method of claim 1, said hook load and axial displacement being measured at a similar location above the well bore.

3. The method of claim 1, further comprising the steps of:

measuring surface torque and angular position of the drillstring;

correlating the measurements of surface torque and angular position so as to produce a second graphical curve of the correlation;

identifying a slope discontinuity along said second graphical curve, said slope discontinuity being indicative of contact resistance between the drillstring and the well bore; and comparing the slope discontinuity of said first graphical curve of hook load and axial displacement with the slope discontinuity of the second graphical curve of surface torque and angular position.

4. A method of determining a condition of contact resistance between a drillstring and a well bore comprising the steps of:

measuring hook load and axial displacement of the drillstring while raising the drillstring from a resting position;

correlating the measurements of hook load and axial displacement so as to produce a graphical curve of the correlation; and identifying a slope discontinuity along said graphical curve, said slope discontinuity being indicative of contact resistance along an area of contact between the drillstring and the well bore;

computing a slope of the graphical curve of the correlation of axial displacement and hook load;

determining an instantaneous axial compliance at a point along said slope; and computing a depth of the area of contact based on said instantaneous axial compliance relative to a given surface axial load.

5. A method of determining a condition of contact resistance between a drillstring and a well bore comprising the steps of:

measuring surface torque and angular position of the drillstring while rotating the drillstring through one rotation from a resting position;

correlating the measurements of surface torque and angular position so as to produce a graphical curve of the correlation; and identifying a slope discontinuity along said graphical curve, said slope discontinuity being indicative of contact resistance between the drillstring and the well bore.

6. The method of claim 5, said slope discontinuity being a curve segment, said step of identifying comprising:

computing a curvature of said curved segment, said curvature being representative of a magnitude of a distributed contact resistance along an area of contact between the drillstring and the well bore.

7. The method of claim 5, further comprising the steps of:

computing a slope of the graphical curve of the correlation of surface torque and angular position;

determining an instantaneous rotational compliance at a point along said slope; and computing a depth of the area of contact based on said instantaneous rotational compliance relative to a given surface torque.

8. The method of claim 5, said surface torque and said angular position being measured at similar locations above the well bore.

9. The method of claim 5, further comprising the steps of:

measuring hook load and axial displacement of the drillstring;

correlating the measurements of hook load and axial displacement so as to produce a second graphical curve of the correlation;

identifying a slope discontinuity along said second graphical curve, said slope discontinuity being indicative of a contact resistance between the drillstring and the well bore; and comparing the slope discontinuity of said first graphical curve of surface torque and angular position with said second graphical curve of hook load and axial displacement.

* * * * *